US008464487B2

(12) United States Patent
Kenda et al.

(10) Patent No.: US 8,464,487 B2
(45) Date of Patent: Jun. 18, 2013

(54) MODULAR SYSTEM FOR A FAçADE STRUCTURE

(75) Inventors: Mario Kenda, Bruhl (DE); Jürgen Neuwald, Koblenz (DE); Horst Schmitt, Kelberg (DE)

(73) Assignee: Kalzip GmbH, Koblenz (DE)

( * ) Notice: Subject to any disclaimer, the term of this patent is extended or adjusted under 35 U.S.C. 154(b) by 52 days.

(21) Appl. No.: 13/003,876

(22) PCT Filed: Jun. 29, 2009

(86) PCT No.: PCT/EP2009/004677

§ 371 (c)(1),
(2), (4) Date: Mar. 7, 2011

(87) PCT Pub. No.: WO2010/006691

PCT Pub. Date: Jan. 21, 2010

(65) Prior Publication Data

US 2011/0146182 A1 Jun. 23, 2011

Related U.S. Application Data

(60) Provisional application No. 61/081,540, filed on Jul. 17, 2008.

(30) Foreign Application Priority Data

Jul. 16, 2008 (EP) ..... 08012840

(51) Int. Cl.
*E04B 9/00* (2006.01)

(52) U.S. Cl.
USPC ..... 52/474; 52/483.1; 52/506.08

(58) Field of Classification Search
USPC ..... 52/474, 483.1, 489.1, 489.2, 506.08, 52/506.09
See application file for complete search history.

(56) References Cited

U.S. PATENT DOCUMENTS

| | | | | |
|---|---|---|---|---|
| 2,607,971 | A | 8/1952 | Bedford, Jr. | |
| 3,548,556 | A * | 12/1970 | Vermeulen | 52/506.06 |
| 5,692,345 | A | 12/1997 | Mogaki et al. | |
| 2005/0183369 | A1 | 8/2005 | Jung | |
| 2011/0011023 | A1 * | 1/2011 | Gulbrandsen et al. | 52/506.07 |

FOREIGN PATENT DOCUMENTS

| | | |
|---|---|---|
| BE | 900278 | 2/1985 |
| DE | 1 659 952 | 10/1969 |
| EP | 1 233 118 A2 | 8/2002 |
| GB | 1132773 | 11/1968 |
| GB | 1 158 704 | 7/1969 |
| WO | 00/23672 A1 | 4/2000 |

* cited by examiner

*Primary Examiner* — Jeanette E Chapman
*Assistant Examiner* — Daniel Kenny
(74) *Attorney, Agent, or Firm* — Novak Druce Connolly Bove + Quigg, LLP

(57) ABSTRACT

A modular system for a façade structure for a building comprising panels and panel retaining elements for mounting the panels to the building and method for producing said facade.

Figure 1:
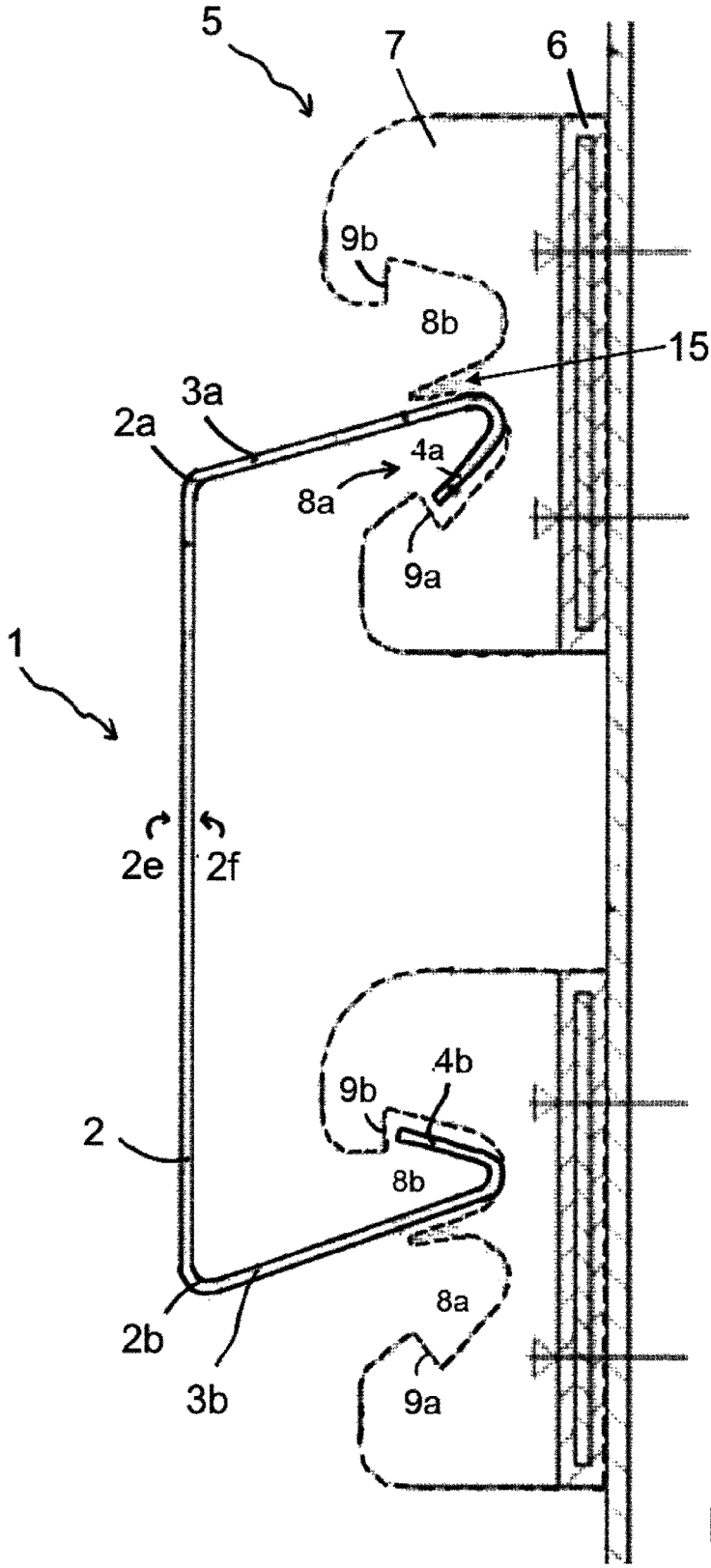

19 Claims, 10 Drawing Sheets a.

b.

c.

MODULAR SYSTEM FOR A FAçADE STRUCTURE

CROSS-REFERENCE TO RELATED APPLICATION

This application is a §371 National Stage Application of International Application No. PCT/EP2009/004677, filed on 29 Jun. 2009, and claims the priority of U.S. provisional application no. 61/081,540 filed on 17 Jul. 2008 and European Patent Application No. 08012840.8 filed on 16 Jul. 2008.

The present invention relates to a modular system for a façade structure for a building comprising panels and panel retaining elements for mounting the panels to the building. The invention also relates to a façade structure made using said modular system.

Nowadays many buildings, and especially the façades and roofs thereof, are constructed from metal panels. These metal panels are attached to buildings by interlocking parts of the panels and attaching the panels to the support structure of the building by means of screwing the parts directly to the support structure, or by means of specially designed clamps which are screwed to the support structure.

The interlock is frequently achieved by using the male and female principle. The construction of such buildings usually starts with erecting a framework comprising building elements to which the metal panels, for instance for the roof or façade, are attached. Depending on the type of panel, the interlocking system requires starting the attachment of the panels at a lower level and working upwards or the other way around. In all cases the next panel firmly locks the preceding panel in place.

A disadvantage of the application of said panels is that when an intermediate panel needs to be replaced, for instance when it is damaged, these panels can only be replaced without destroying the panel by removing the other panels which were installed after the damaged panel are removed as well. The alternative of cutting the intermediate damaged panel and/or destroying the points of suspension of the damaged panel, allows the panel to be removed without the need to remove other panels. Afterwards, the points of suspension need to be repaired. This is a difficult and time-consuming operation.

It is an object of the present invention to provide an assembly for a façade of a building which enables quick mounting of the façade.

It is also an object of the present invention to provide an assembly for a façade of a building which enables mounting of the panels in any chosen order.

It is also an object of the present invention to provide an assembly for a façade of a building which enables to easily replace a damaged panel without having to remove additional undamaged panels.

To achieve one or more of these objectives a modular system for a façade structure for a building comprising panels and panel retaining elements for mounting the panels to the building is provided, wherein said panels 1 comprise an intermediate portion 2 extending between two upstanding flanges 3*a*, 3*b* located on opposite edges 2*a*,2*b* of the intermediate portion 2 and wherein the free ends 4*a*,4*b* of the upstanding flanges 3*a*,3*b* are bent so as to extend towards the back side 2*f* of the intermediate portion of the panel 1 thereby forming substantially v- or u-shaped flanges and wherein the free ends 4*a*,4*b* of the bent upstanding flanged do not touch the back side 2*f* of the intermediate portion 2, and wherein said panel retaining elements 5 comprise a base portion 6 for securing the retaining element to the building and at least one upstanding flange 7, wherein the upstanding flange 7 is provided with recesses 8*a*,8*b*, and which recesses are provided with securing notches 9*a*,9*b* so as allow mounting the panels to the building structure by snapping (i.e. synonym of clicking) the v- or u-shaped flanges of the panels into the corresponding recesses 8*a*,8*b* in the upstanding flanges 7 of one or more retaining elements 5, and wherein the securing notches 9*a*,9*b* secure the panels in place.

The mounting of the panels preferably occurs by hanging the upper upstanding flange part of a panel in the recesses 8*b*, allowing it to hang onto the securing notch 9*b*, and then clicking the lower upstanding flange into the recess 8*a*, allowing it to be secured by the securing notch 9*a*. Alternatively, but not preferably, the panels may be mounted by pressing the two upstanding flanges of one panel into the recesses and behind securing notches simultaneously. It is important to note that there is no need to mount two adjoining panels simultaneously by clicking the flanges of the two adjoining panels into the recesses of a mounting bracket simultaneously. The clicking in place of the flange of one panel into the recess of a mounting bracket can be done before the hanging in place of the adjoining panel in the other recess of said mounting bracket.

As a consequence of the shape of the panels, when the upstanding flanges on the panel are pressed outwardly, the flexing of the intermediate portion and the elastic resistance of the flanges will exert an inwardly directed force which will allow in the bent-away free ends of the upstanding flanges on the panel as one-way beards which are initially pressed in the recesses of the retaining element, and the spring-back of the flanges will ensure that the free edges hook behind the securing notches in the retaining elements. The deformation of the upstanding flanges during mounting is preferably an elastic deformation only. When after the panel is mounted a pulling force is exerted on the panel, the free edges will move inwardly, thereby increasing the grip on the securing notches and preventing pull-out of the panel. When after the panel is mounted a pushing force is exerted on the panel, the free edges will move outwardly, but the securing notches are dimensioned such that the grip on the securing notches is retained and the panel remains in place. By using this mounting by clicking and snapping into place without the use of a male-female connection between the subsequent panels, the order of mounting the panel to the building in terms of direction is irrelevant. It is even possible to leave out certain panels, for instance for permitting to secure a scaffolding to the building. After the upper panels have been snapped into place, the scaffold can be gradually removed, and the gaps in the façade can be filled by snapping a panel where the scaffolding was secured at the building. Ugly visible residual scaffolding securing elements on the façade are thereby prevented. The intermediate portion of the panel is preferably rectangular in shape, because this way the panels are cheapest and more or less interchangeable. However, for buildings with a specific curvature, it is also possible to use the modular system according to the invention by producing and using panels with a tapered intermediate portion, an X-shaped intermediate portion, a concave intermediate portion, a convex intermediate portion or combination thereof. Reference is made to panels to standing seam roofs in this respect where panels having these types of intermediate portion are already widely used (see FIG. 10). It is preferable that the opposite edges 2*a*,2*b* of the intermediate portion of adjoining panels abut, so as to achieve a snug fit between two adjoining panels. The opposite edges with the upstanding flanges are defined to be in the width direction of the panel, whereas the distance between the two upstanding flanges on one panel is defined as the height direction of the panel. However, to enable thermal expansion of the panels, or for aesthetic reasons, it may be necessary to leave a gap between the opposite edges of the intermediate portion of adjoining panels. The gap also allows a certain degree of ventilation, so that any moisture which may have become lodged behind the façade or roof can evaporate.

The recesses may have a substantially complementary shape to the shape of the substantially v- or u-shaped flanges of the panels. In a preferred embodiment of the invention, the securing notches are elongated so as to create a slot-shaped or slit-shaped recess to receive the free ends of the upstanding flanges.

Figure 9:
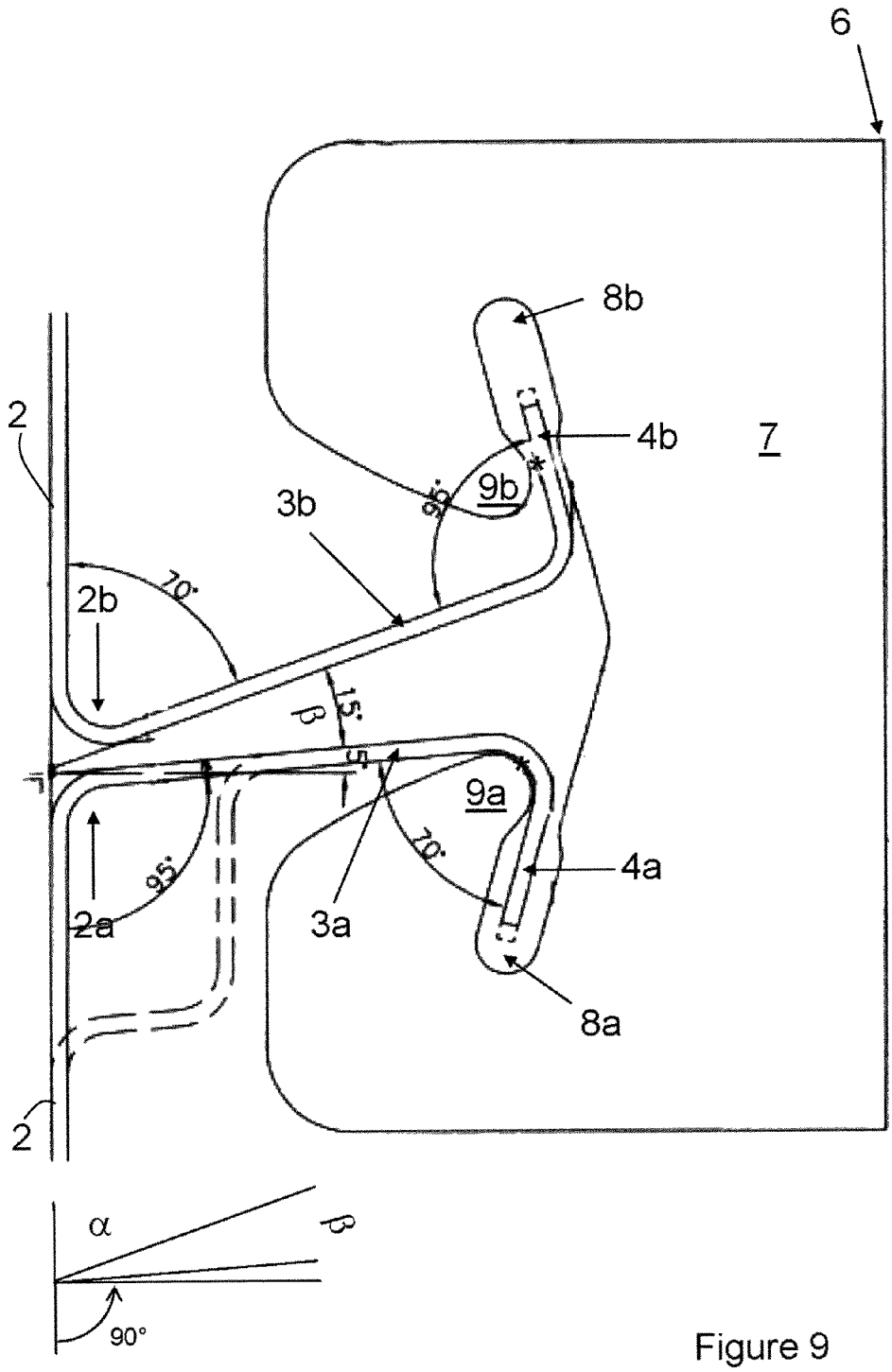

In an embodiment the free ends of the upstanding flanges abut the securing notches of the recesses in the retaining elements head-on, i.e. the extremity of the free end touches the securing notch when a pulling force is exerted on the panel. Preferably, the recesses are slot- or slit-shaped as a result of the elongation of the securing notches. The advantage of the use of such a shaped recess is that the demand on tolerance of the length of the free edge may be slightly relaxed because the end of the free end generally does not touch the far end of the recess. The distance between the end of the free end and the far end of the recess is the length tolerance that the panel can endure. The dashed extension of the free ends in FIG. 9 illustrates this clearly. In this embodiment the inside edge or the bend between the upstanding flange and the free end of the upstanding flange abut the securing notch when a pulling force is exerted on the panel. These touching points are indicated with the asterisk (*) in FIG. 9.

The panels may comprise a perforated or mesh portion in the intermediate portion. Although the intermediate portion is preferably flat to produce a smooth façade, it is also possible to provide the intermediate portion with beads, stiffening ribs, micro lines or ridges. This may have a technical reason, e.g. to increase stiffness of the panel, or an aesthetical reason.

In an embodiment of the invention the angle between one of the upstanding flanges and the intermediate portion of the panels is smaller than 90°. When the panels are mounted on a vertical or tilted surface (i.e. non-horizontal), the panels are mounted such that the angle between the bottom flange and the intermediate portion is the acute angle, and the angle between the top flange and the intermediate portion is the obtuse angle. In an embodiment of the invention the angle between one of the upstanding flanges and the intermediate portion of the panels is larger than 90°. In an embodiment of the invention the angle between one of the upstanding flanges and the intermediate portion of the panels is smaller than 90° and the angle between the other upstanding flange and the intermediate portion of the panel is larger than 90°.

In an embodiment of the invention, one, more or all of the retaining element 5 comprise two upstanding flanges 7*a*,7*b*, wherein both upstanding flanges are provided with recesses 8*a*,8*b* which are substantially complementary to the shape of the substantially v- or u-shaped flanges of the panel 1, and which recesses 8*a*,8*b* are provided with securing notches 9*a*,9*b*.

This embodiment allows an even more secure mounting of the panel into the retaining element by using both upstanding flanges of the retaining element to hold the upstanding flange of one panel, or it allows two neighbouring panels to be mounted, one using the one upstanding flange of the retaining element, and the neighbouring panel in the other upstanding flange.

In an embodiment of the invention the upstanding flanges 3*a*, 3*b* of the panels are not perpendicular to the intermediate portion 2 when the panel is seen in cross section along a line perpendicular to the edges 2*a*, 2*b*, but wherein the angle formed by the intermediate portion and the first upstanding flange 3*b* is a°, and the angle formed by the intermediate portion and the second upstanding flange 3*a* is $(180-(\alpha+\beta)°)$.

In this embodiment, the tilted upstanding flanges result in a tilted gap between two adjoining panels, particularly when mounted vertically, which prevents our counteracts water to seep through the gap towards the building or the support structure. The angle between the two adjoining flanges, $\beta$, is 0 in this case. When the panels are mounted in a more or less vertical position, the angle $\alpha$ is sharp, i.e. less than 90° to avoid water permeating through the gap between two adjoining upstanding flanges of two adjoining panels. Although in the absence of a sealant between the two adjoining panels there will always be some capillary effect, this will not result in water penetrating the façade, particularly not when $\beta$ is not zero, because the capillary effect is reduced when the distance between the two upstanding flanges increases. A positive $\beta$ result in an increasing distance (see FIG. 4).

Figure 3:
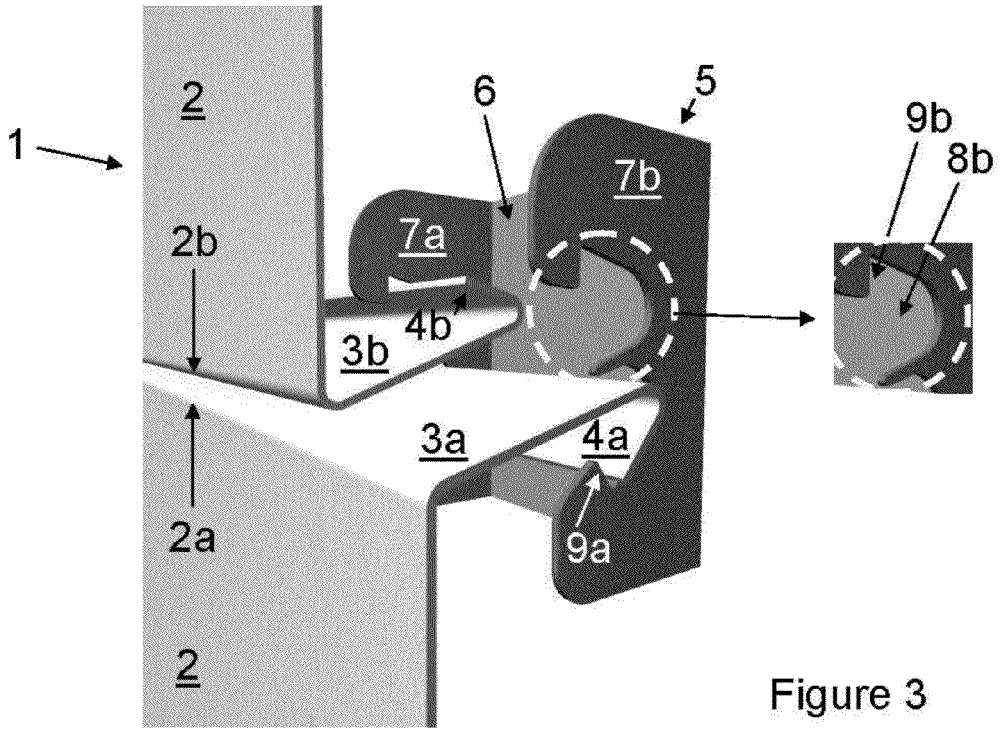

However, it will be clear that this embodiment will also comprise panels wherein $\beta$ is not 0. This results in the upstanding flanges of adjoining panels not to be precisely parallel leading to a gap between upstanding flanges of the two panels not to be equidistant (see FIG. 4) but the gap is wider near the building structure. This widening gap effectively counteracts the capillary effect that such a gap may have, and penetration of moisture through the gap is reduced or prevented. The preferably downward sloping of the gap as illustrated in FIG. 3 counteracts penetration of moisture as well as the penetration of wind driven rain. Since the sharp angle between the intermediate portion 2 and 3*b* of one panel is defined as $\alpha$, the obtuse angle between intermediate portion 2 and 3*a* of the adjoining panel is $180-(\alpha+\beta)$.

The inventors found that it may even be beneficial to use panels wherein $\beta$ is larger than 5° because it allows quick and precise mounting of the panels. It was found that $\beta$ is preferably larger than 5°. It is preferable that the angle is not larger than 25°. In a preferred embodiment the angle is between 10 and 20°, e.g. 15°.

In an embodiment of the invention the panels are made from sheet material of steel, a steel alloy, aluminium or an aluminium alloy, preferably by roll-forming, and wherein the panels are optionally coated with coating layers providing the panels with corrosion protection and/or colour and/or texture. A suitable thickness of the panels is between 0.5 and 2.5 mm, e.g. about 1 mm.

Since the shape of the panel is relatively simple, it can be produced cheaply. The panels may be produced by simple bending or press-braking, but preferably by roll-forming. By using a dedicated roll-former, the panels can be produced on the erection site of a building. Such a dedicated roll-former may be transported to the erection site in a standard transport- or sea-container In an embodiment of the invention a plurality of panel retaining elements is mounted onto the building and adjoining panels are snapped into the recesses 8*a*,8*b* of the retaining elements and wherein the upstanding flange 3*a* of a first panel and the upstanding flange 3*b* of a second panel longitudinally adjoin so as to allow mounting the adjoining panels to the building by snapping the adjoining v- or u-shaped flanges of the panels into the corresponding recesses 8*a*,8*b* in the upstanding flanges 7 of one or more retaining elements 5. Longitudinal adjoining means that the edge 2*a* of one panel adjoins the edge 2*b* of the adjoining panel.

The panel retaining elements may be mounted to the building individually as single brackets, or as a part of a rail comprising a plurality of brackets over the length of the rail.

Figure 11:
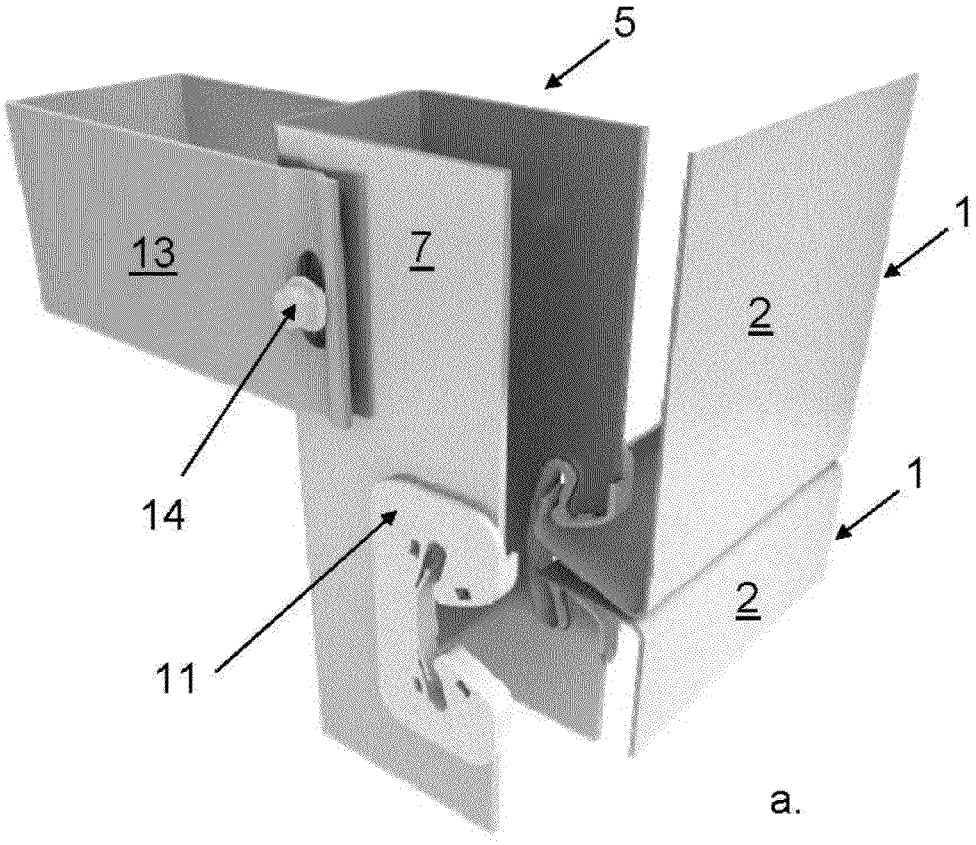
Figure 11:
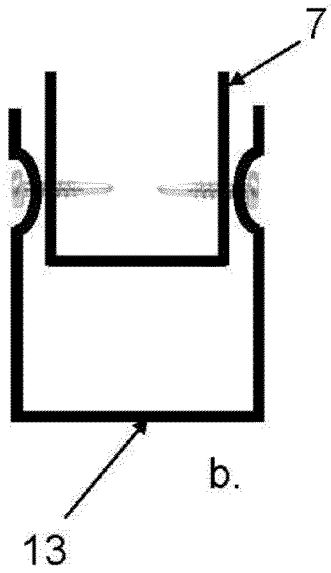
Figure 11:
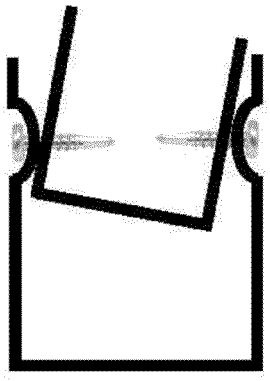

The plurality of brackets over the length of the rail may be individually pre-mounted single brackets, or the rail may be provided with recesses to receive and hold the upstanding flanges of the panels (item 5 in FIG. 11*a*). In a further embodiment, the single brackets or the rail comprising the plurality of brackets are mounted to the building using a further U-shaped bracket (item 13 in FIG. 11) which allow for some translational tolerance during mounting of the rails or brackets to the building, thereby facilitating alignment of the rails or brackets, preferably wherein the legs of the U-shaped bracket are provided with notches which allow the U-shaped bracket to take up some rotational tolerance during mounting of the rails or brackets to the building.

In this embodiment, the gap between two adjoining panels is identical over the entire length of the two adjoining panels, thereby achieving a nice (i.e. aesthetically pleasing) finish of the façade. By using panels with a recess in the upstanding flange, the recess is identical over the entire length of the two adjoining panel. The presence of such a gap allows for thermal expansion of the panel without the risk of buckling the flat part of the panel. It also allows for ventilation and a degree of pressure equalisation between the front and back sides of the panel when subjected to dynamic wind loads, and thereby reduces wind-suction effects.

In an embodiment of the invention a plurality of panel retaining elements is mounted onto the building and wherein the upstanding flanges 3*a*,3*b* of a first panel are snapped into the recesses 8*a*,8*b* of one upstanding flange of a retaining element and wherein the upstanding flanges 3*a*,3*b* of a neighbouring panel are snapped into the recesses 8*a*,8*b* of the other upstanding flange of the retaining element preferably wherein the gap between the two neighbouring panels is minimised by abutting the edge 2*c* of the intermediate portion of the first panel against the edge 2*d* of the intermediate portion of the neighbouring panel.

In this embodiment, there is no gap between two neighbouring panels, thereby achieving a smooth finish of the façade.

In an embodiment of the invention, an intermediate material is provided between the upstanding flanges and the panel retaining element when mounted. This intermediate material may prevents the occurrence of rattling as a result of metal-metal contact, for instance in windy circumstances. This intermediate material may be in the form of a layer or material, or a loose inlay which e.g. is put in place in the recesses of the clip prior to clicking the panel in place, or an inlay which is clipped into or onto the recesses of the clip prior to clicking the panel in place. The material may be a polymer material, such as a plastic or a rubber-like material. The intermediate material may also be used to improve an reduced friction of the panels during mounting, or to correct minor size deviations (tolerance). By using different materials at different retaining elements, some panel retaining elements could be used as fixed points (by using high friction material) whereas other retaining elements could allow some movement to allow the thermal expansion of the panels (by using very low friction material). The intermediate material may also be provided with beards or spring elements so as to allow easy insertion of the panel in one direction during mounting the panel and difficult extraction in the opposite direction, thereby adding to the gripping power of the retaining element on the flanges of the panel when a pulling force is exerted on the panel.

In an embodiment of the invention the panels may also be provided with an upstanding flange at one or both of the edges 2*c* and/or 2*d*. This upstanding flange may serve to create an aesthetic or safety enhancing effect when the panel is mounted as the last panel near the edge of the façade. This upstanding flange would preferably be bent in the same direction as the upstanding flanges which are clipped into the panel retaining elements. It is preferable that this upstanding flange is provided to the panel on the building site. This has the advantage that the width of the panel can be fine-tuned on site by cutting the panel to the correct width followed by bending the edge. To enable a nice finish of the panel, the corners of the panel need to be cut out prior to bending the flange to avoid creases in the panel.

It should be noted that the modular system according to the invention would also be suitable for producing a roof structure. However, as the roof would not be impermeable to water at the locations where the panels abut, it is used as an over-cladding, e.g. over a standing seam roof which is waterproof, where the standing seams can be used to fix the panel retaining elements to. Additional precautions to make the roof impermeable to water at the location of the where panels adjoining by sealing the gaps between adjoining and/or neighbouring panels e.g. by using a sealant, or waterproof inlays or rubberlike profiles have proven not to provide a long term waterproofing. Use of the modular system for producing a ceiling structure (i.e. indoors) is also possible. The combination of such a ceiling, for instance with perforated or mesh intermediate portions in the panels, with sound-proofing material behind the intermediate portion provides an acoustic ceiling. Heating or cooling elements may also be mounted behind the perforated panels.

According to a second aspect of the invention a method of assembling a façade structure on a building using a plurality of panels 1 members and panel retaining elements 5 for mounting the panels to the building is provided wherein said panels 1 comprise an intermediate portion 2 extending between two upstanding flanges 3*a*,3*b* located on opposite edges 2*a*,2*b* of the intermediate portion 2 and wherein the free ends 4*a*,4*b* of the upstanding flanges 3*a*,3*b* are bent so as to extend towards the back side 2*f* of the intermediate portion of the panel 1 thereby forming substantially v- or u-shaped flanges and wherein the free ends 4*a*,4*b* of the bent upstanding flanged do not touch the back side 2*f* of the intermediate portion 2, and wherein said panel retaining elements 5 comprise a base portion 6 for securing the retaining element to the building and at least one upstanding flange 7, wherein the upstanding flange 7 is provided with recesses 8*a*,8*b* which have a substantially complementary shape to the shape of the substantially v- or u-shaped flanges of the panels, and which recesses are provided with securing notches 9*a*,9*b* the method comprising the step of mounting subsequent panels to the building structure by snapping the v- or u-shaped flanges of the panels into the corresponding recesses 8*a*,8*b* in the upstanding flanges 7 of one or more retaining elements 5, and wherein the securing notches 9*a*,9*b* secure the panels in place.

The mounting of the panels preferably occurs by hanging the upper upstanding flange part of a panel in the recesses 8*b*, allowing it to hang onto the securing notch 9*b*, and then clicking the lower upstanding flange into the recess 8*a*, allowing it to be secured by the securing notch 9*a*. Alternatively, but less preferably, the panels may be mounted by pressing the two upstanding flanges into the recesses and behind securing notches simultaneously.

Since these panels do not rely on the male-female interlocking system, there is no prescribed order of mounting the panels. The mounting may start at the bottom of the façade and move upwards, or start at the top of the façade and move downwards, or the mounting may start at any chosen place of the building and move upwards and downwards. It is even possible to leave out panels during construction, only to fill the gaps later. This may be extremely helpful when during building a scaffolding is used. For safety reasons, such a scaffolding needs to be secured to the building. By securing the scaffolding to the building at the locations where the panels are not yet mounted the securing points can later be covered by a panel when the scaffolding is removed. The clicking into place and the self-securing behind the securing notches of the panel retaining elements means that the panels can be very easily and quickly mounted by a simple pressing and snapping into place, even in between panels already mounted. The deformation of the upstanding flanges during mounting is preferably an elastic deformation only. The fact that the order of mounting the panels is irrelevant is also important when mounting coloured panels. Minimal differences in colour or texture of subsequent batches of material from which the panels are produced, e.g. by roll forming, become visible when consecutively mounting all panels of one coil and then all panels of another batch. The method according to the invention allows mounting the panels scattered over the façade and filling the gaps scattered with the panels of any following bath. The scattering eliminates any differences in texture or colour.

In an embodiment of the invention the method involves using one, more or all retaining elements wherein the retaining elements comprise two upstanding flanges 7*a*,7*b*, wherein both upstanding flanges are provided with recesses 8*a*,8*b* which are substantially complementary to the shape of the substantially v- or u-shaped flanges of the panel 1, and which recesses 8*a*,8*b* are provided with securing notches 9*a*,9*b*. This embodiment allows an even more secure mounting of the panel into the retaining element by using both upstanding flanges of the retaining element to hold the upstanding flange of one panel, or it allows two neighbouring panels to be mounted, one using the one upstanding flange of the retaining element, and the neighbouring panel in the other upstanding flange.

In an embodiment of the invention, the method of assembling a façade involves mounting consecutive panels in such a manner that the gap between the two neighbouring panels is minimised by abutting the edge 2*c* of the intermediate portion of the first panel against the edge 2*d* of the intermediate portion of the neighbouring panel. In this embodiment, there is no gap between two neighbouring panels, thereby achieving a smooth finish of the façade.

In an embodiment of the invention the method uses panels with upstanding flanges of the panels which are not perpendicular to the intermediate portion when the panel is seen in cross section along a line perpendicular to the edges, but wherein the angle formed by the intermediate portion and the first upstanding flange is $\alpha°$, and the angle formed by the intermediate portion and the second upstanding flange is $(180-(\alpha+\beta))°$. In this embodiment, the tilted upstanding flanges result in a tilted gap between two adjoining panels, particularly when mounted vertically, which prevents our counteracts water to seep through the gap towards the building or the support structure. Another advantage of using the tilted flanges is that the panels can not be inadvertently mounted upside down. Particularly when using coloured or textured panels this avoids apparent colour differences because all panels are mounted in the same direction.

In an embodiment of the invention a method of repairing the façade structure is provided comprising the steps of removing the damaged panel or damaged panels individually, for instance by cutting the member so as to enable removal of the panel without damaging the panel retaining elements holding the damaged panel, followed by replacing the removed panel by snapping a replacement panel in place. Due to the absence of the male-female interlocking, only the damaged panels need to be removed. By removing the damaged panel(s) without damage to the retaining elements, replacement panel of the correct size can be easily and quickly snapped in place. This repair option is very important in locations where damage to the panel can occur for instance by accidents or vandalism such as scratching, graffiti or even shooting using firearms.

The invention will now be further described by way of non-limiting examples and with reference to the accompanying drawings in which:

FIG. 1 shows a schematic drawing of a panel clamped into the panel retaining elements. The panel 1 is not to scale. The height of the upstanding flanges 3*a*, 3*b* located on opposite edges 2*a*, 2*b* of the intermediate portion 2 is exaggerated in respect to the size of the intermediate portion. In practice, the retaining elements 5 are mounted at a larger distance from each other. The free ends 4*a*, 4*b* of the upstanding flanges 3*a*, 3*b* are bent and extend towards the back side 2*f* of the intermediate portion thereby forming substantially v- or u-shaped flanges The panel retaining elements 5 comprise a base portion 6 for securing the retaining element to the building and at least one upstanding flange 7, which is provided with recesses 8*a*, 8*b* having a substantially complementary shape to the shape of the v- or u-shaped flanges of the panels, and which are provided with securing notches 9*a*, 9*b* so as allow mounting the panels to the building structure by snapping the v- or u-shaped flanges of the panels into the corresponding recesses 8*a*, 8*b*.

Figure 2:
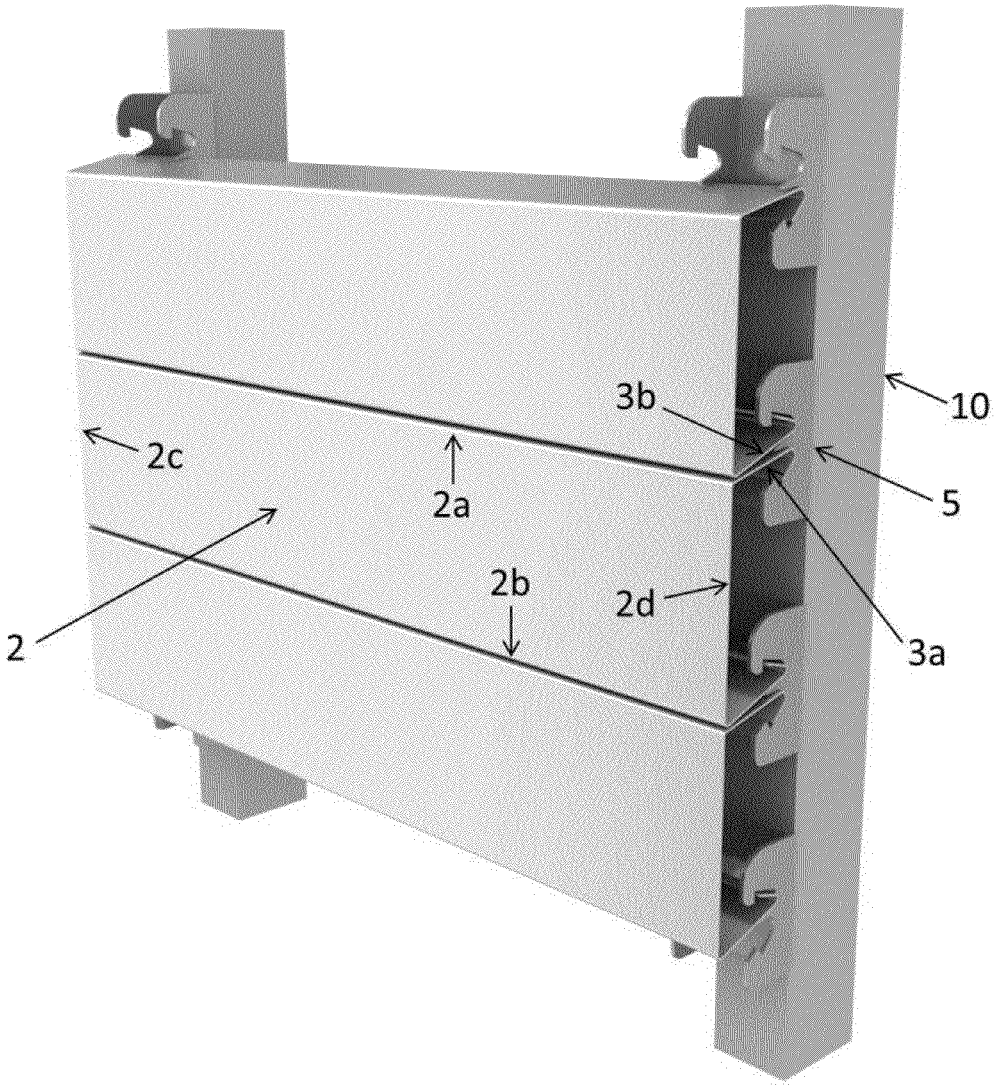

FIG. 2 shows a drawing of a part of a façade mounted on a support structure. The three panels adjoin, showing a nice even gap to the observer, and a smooth finish of the façade. The panel retaining elements 5 are mounted onto support structure 10.

Figure 4:
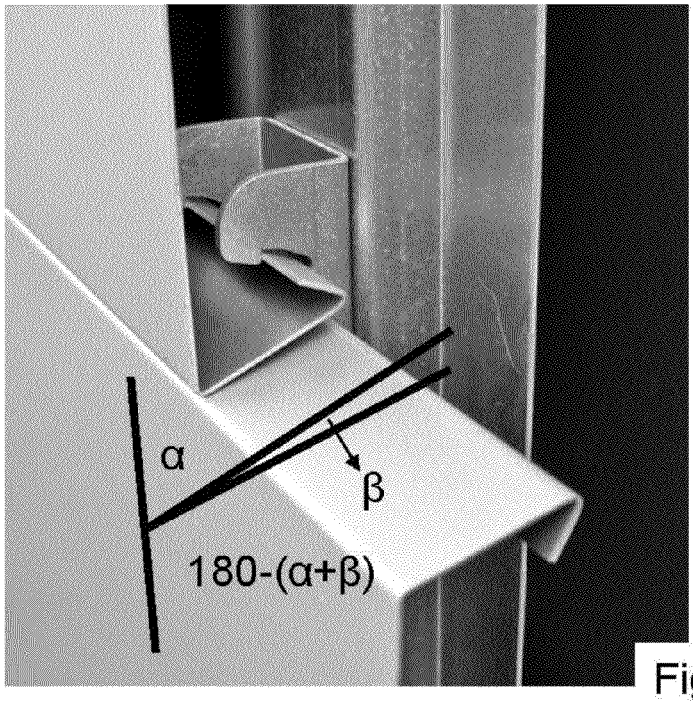

FIG. 3 shows a schematic drawing of two adjoining panels mounted in one panel retaining element. The reference numerals are as explained hereinabove. FIG. 4 shows a photographic representation of two adjoining panels mounted in one panel retaining element as schematically shown in FIG. 3. It is clearly visible that the gap between the two adjoining upstanding flanges 3*b* and 3*a* opens up towards the support structure. The angle between the two flanges is $\beta°$. The sharp angle between the intermediate portion 2 and 3*b* of one panel is defined as $\alpha$, so that the obtuse angle between intermediate portion 2 and 3*a* of the adjoining panel is $180-(\alpha+\beta)$. This is schematically indicated in FIG. 4.

Figure 5:
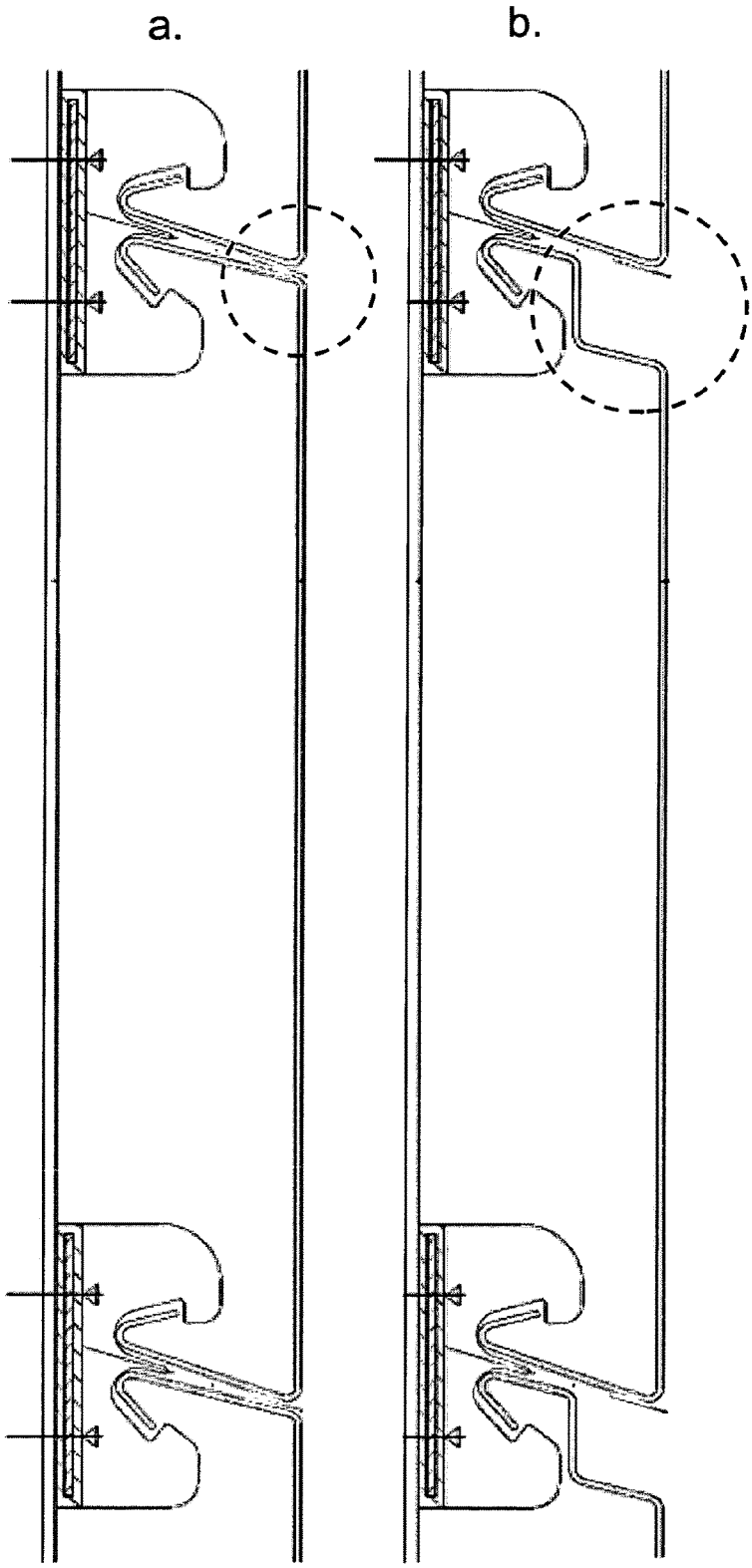

FIG. 5 shows a schematic drawing of two adjoining panels without a gap in the façade (a), and with a gap running over the façade (b). In FIG. 5*a* the panels are used resulting in the façade of FIG. 2. When the panel of FIG. 5*b* is used, a wider gap is visible in the façade. This may have a desired esthetical or functional effect.

Figure 6:
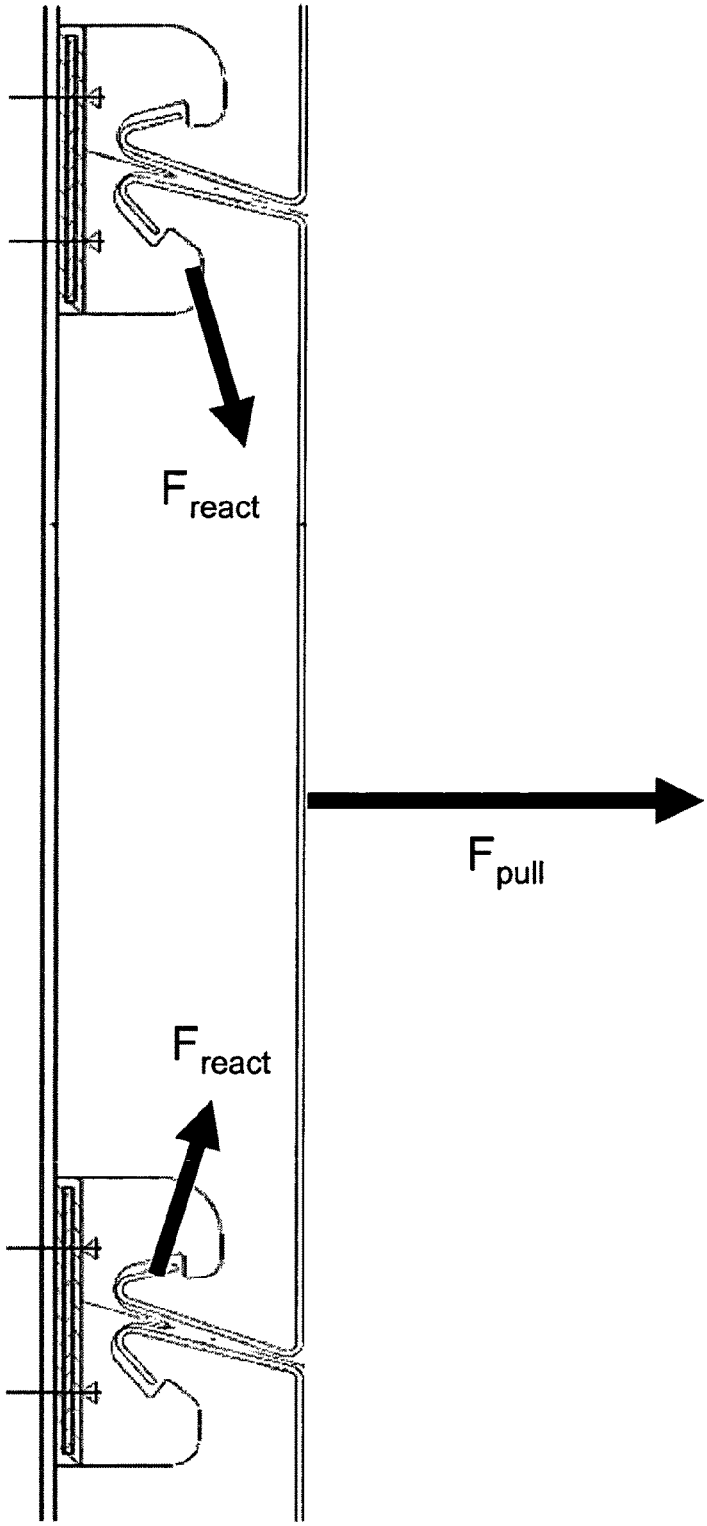

FIG. 6 shows a schematic drawing of the effect of a pulling force, for instance by wind suction, on the intermediate portion of a panel. The pulling force makes the free edge 4*a* and 4*b* 'dig' in the securing notches thereby preventing pull-out of the panel.

Figure 7:
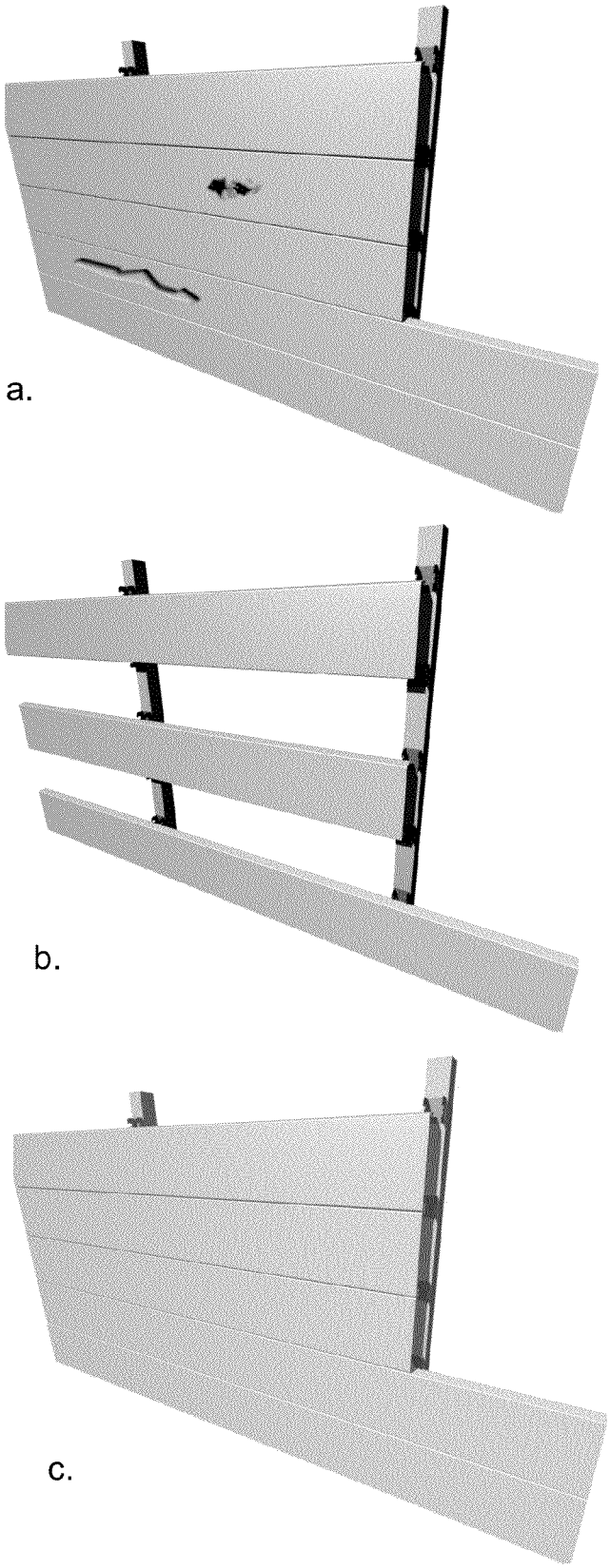

FIG. 7 *a* to *c* shows a sequence of events when replacing damaged panels from a completed façade. By longitudinally cutting the damaged panels, the panels can be removed without damaging the panel retaining elements. New panels can be easily inserted between the undamaged panels.

Figure 8:
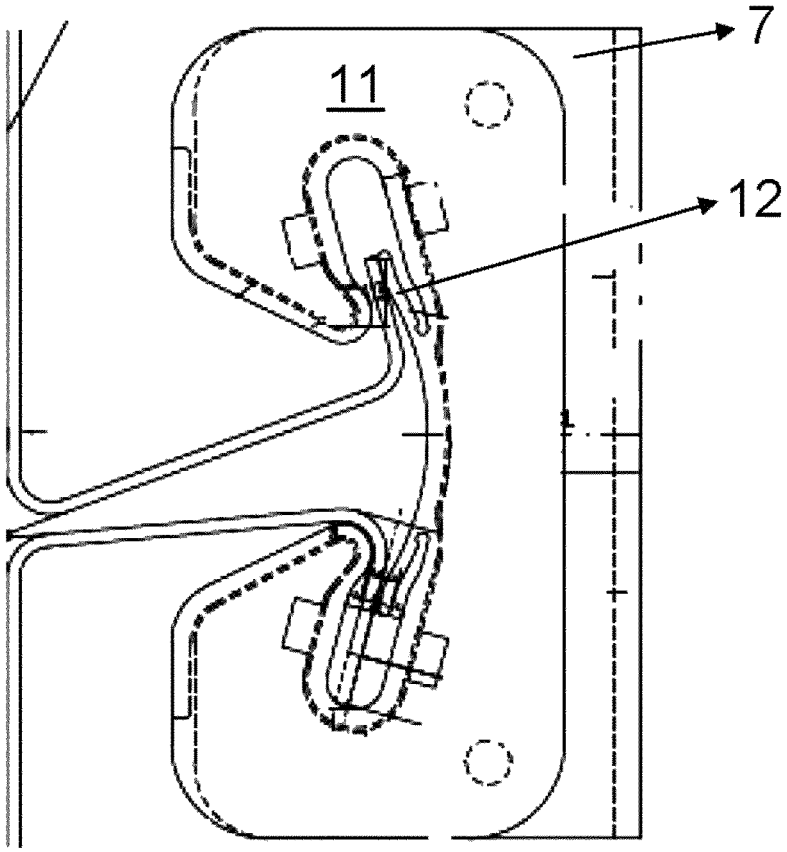

FIG. 8 shows an example of a loose inlay 11 as an intermediate material which is made by injection moulding and which is clipped to the recesses in the panel retaining elements 5. The beards or spring elements 12 to retain the free edges 4*a*,4*b* of the upstanding flanges 3*a*, 3*b* are visible in the slot-shaped recess in the inlay. Snappers are provided to clip and retain the inlays to the upstanding flange or flanges 7 of the panel retaining element 5.

FIG. 9 shows a cross-section of an arrangement according to the invention where the flanged edges of two adjoining panels are slotted in the slot-shaped recessed of the retaining element. The slot-shaped recesses are the result of the elongation of the securing notches 9*a* and 9*b* in comparison to the embodiment of FIG. 1. Also the hill 15 partly defining the recesses in FIG. 1 is absent, because it has no function in this preferable embodiment. By means of non-limiting example some angles at the flanges are indicated. The angle for [beta] is 15[deg.]. The flanged edge of the bottom panel abuts the securing notch 9*a* at the location of the bend of the free end of the flanged edge, whereas the flanged edge of the top panel abuts the securing notch 9*b* with the inner side of the free end of the flanged edge. The touching points are indicated with an asterisk (*). This embodiment is particularly well suited for the mounting by hanging the upper upstanding flange and clicking the lower upstanding flange. This Fix-Click mechanism is preferable over the simultaneous snapping or clicking into place of the upper and lower upstanding flanges.

Figure 10:
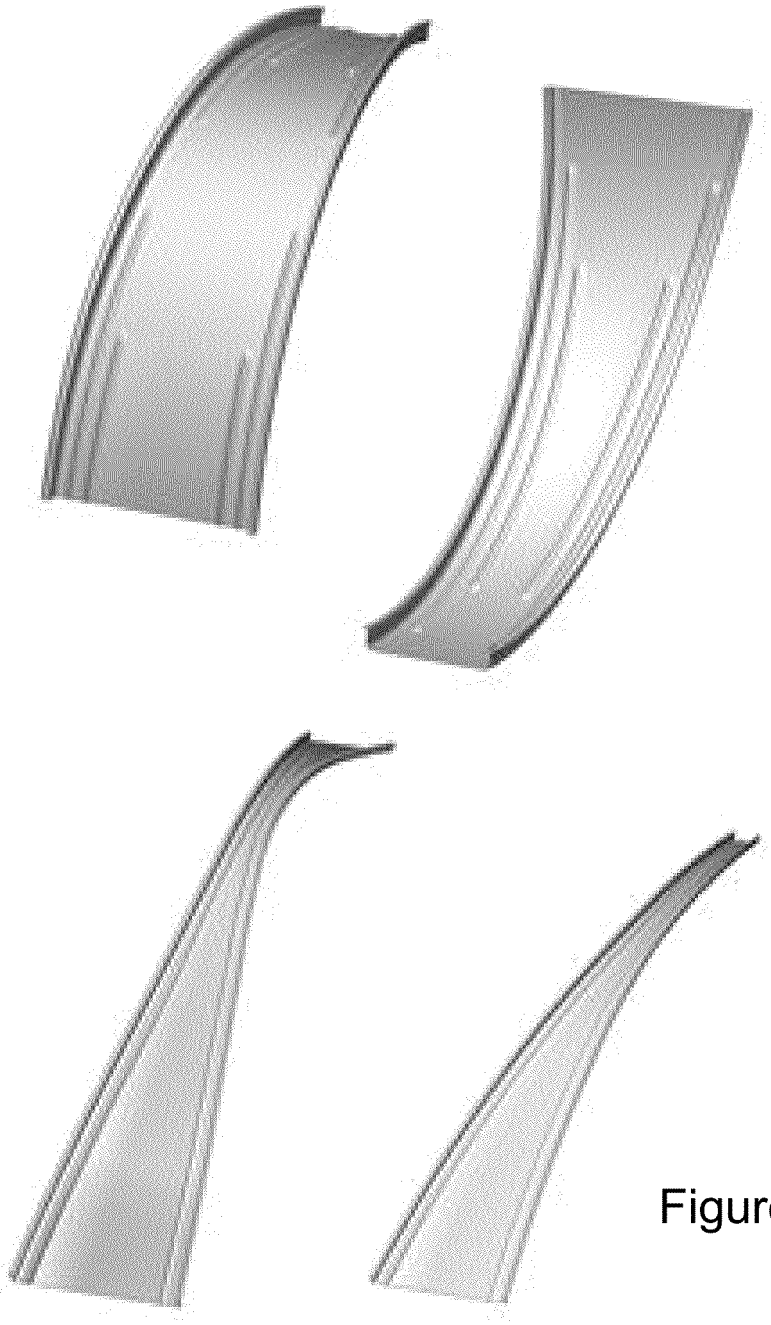

FIG. 10 panels for standing seam roofs with a tapered intermediate portion, an X-shaped intermediate portion, a concave intermediate portion, a convex intermediate portion or combination thereof. These drawings are included to explain the various shapes involved. According to the invention, panels of similar shapes can be used in the modular system according to the invention, wherein the standing seam parts in FIG. 10 are replaced by upstanding flanges in accordance with this invention.

FIG. 11 shows a bracket comprising the loose inlays 11 when clipped into the recesses in the upstanding flanges 7 of the panel retaining element 5. The right inlay 11 is provided with an upper panel clicked into the recess 8 and securing notch 9 and an adjoining lower panel hanged into the recess 8 and securing notch 9. The panel retaining 5 is mounted to the building through a U-shaped bracket 13 by means of a securing element 14 such as a nut-and-bolt, a screw, a blind rivet, or an equivalent, using washers if needed, through a slit-shaped opening in the legs of the U-shaped bracket. In this example the slit-shaped opening is provided in an inwardly directed notch in the leg. This notch allows some rotational tolerance as the rail can be rotated slightly and still be secured in the bracket.

The invention claimed is:

1. A modular system for a facade structure for a building comprising panels and panel retaining elements for mounting the panels to the building, wherein said panels comprise an intermediate portion extending between two panel upstanding flanges located on opposite edges of the intermediate portion and wherein the free ends of the panel upstanding flanges are bent to extend towards the back side of the intermediate portion of the panel thereby forming substantially v- or u-shaped flanges and wherein the free ends of the bent panel upstanding flanges do not touch the back side of the intermediate portion, and wherein said panel retaining elements comprise a base portion for securing the retaining element to the building and at least one retaining element upstanding flange, wherein the retaining element upstanding flange is provided with recesses and which recesses are provided with securing notches to allow mounting the panels to the building structure by snapping the free ends of the v- or u-shaped flanges of the panels into the corresponding recesses in the upstanding flanges of one or more retaining elements, and wherein the securing notches secure the panels in place without the use of a male-female connection between subsequent panels, wherein the angle between one of the upstanding flanges and the intermediate portion of the panels is smaller than 90° and the angle between the other upstanding flange and the intermediate portion of the panel is larger than 90° and wherein the panels are made from sheet material by roll-forming, wherein an angle β between the panel upstanding flanges is greater than 0°.

2. Modular system according to claim 1, wherein one, more or all of the retaining elements comprise two retaining element upstanding flanges, wherein both retaining element upstanding flanges are provided with recesses, and which recesses are provided with securing notches.

3. Modular system according to claim 1, wherein the panel upstanding flanges are not perpendicular to the intermediate portion when the panel is seen in cross section along a line perpendicular to the edges, but wherein the angle formed by the intermediate portion and the first panel upstanding flange is α°, and the angle formed by the intermediate portion and the second panel upstanding flange is $(180-(\alpha+\beta))°$.

4. Modular system according to claim 1, wherein the panels are made from sheet material of steel, a steel alloy, aluminium or an aluminium alloy, and wherein the panels are optionally coated with coating layers providing the panels with corrosion protection and/or colour and/or texture.

5. Modular system according to claim 1, wherein the angle β between the panel upstanding flanges is at least 5°.

6. Modular system according to claim 1, wherein the angle β between the panel upstanding flanges is at most 25°.

7. Modular system according to claim 1, wherein the recesses are slot- or slit-shaped to receive the free ends of the panel upstanding flanges, or wherein the recesses have a shape substantially complementary to the shape of the substantially v- or u-shaped flanges.

8. Modular system according to claim 1, wherein an intermediate material is provided between the upstanding panel flanges and the panel retaining element.

9. Modular system according to claim 8, wherein the intermediate material is provided in the form of a loose inlay.

10. Facade comprising the modular system according to claim 1, wherein a plurality of panel retaining elements is mounted onto the building and wherein adjoining panels are snapped into the recesses of the retaining elements and wherein the upstanding panel flange of a first panel and the upstanding panel flange of a second panel longitudinally adjoin to allow mounting the adjoining panels to the building by snapping the adjoining panel flanges of the panels into the recesses in the upstanding flanges of one or more retaining elements.

11. Modular system according to claim 1, wherein the panel upstanding flange comprises a first leg and a second leg, the first leg having a first end proximal to the panel intermediate portion and a second end distal to the panel intermediate portion, the first leg extending from the panel intermediate portion, and the second leg extending from the distal end of the first leg, the first leg and second leg forming the substantially v- or u-shaped flange and the free end of the second leg points inwardly towards the panel intermediate portion, wherein the free ends of the panel upstanding flange second leg extends towards the back side of the intermediate portion of the panel thereby forming the substantially v- or u-shaped flanges;

wherein a first said second leg of a respective said panel is opposed to a second said second leg of said respective panel.

12. Modular system according to claim 1, wherein said panel retaining elements comprise said base portion for securing the retaining element to the building and said at least one retaining element upstanding flange, wherein the retaining element upstanding flange has a front wall opposed to the base;

wherein the intermediate portion is spaced from the retaining element front wall when the free ends of the v- or u-shaped flanges of the panels are in the corresponding recesses in the upstanding flanges of one or more retaining elements to facilitate removing a snapped in panel, by cutting the panel without damaging the panel retaining elements holding the panel.

13. Modular system according to claim 12, wherein said retaining elements are spaced from each other, each retaining element comprising two retaining element upstanding flanges, wherein both retaining element upstanding flanges are provided with adjacent recesses, and which recesses are provided with securing notches, wherein one upright flange of each panel is in a first said retaining element and the other upright flange of said panel is in a second said retaining element spaced from the first retaining element.

14. Modular system according to claim 12, wherein opposite edges of the intermediate portion of adjoining snapped in panels abut.

15. Facade comprising the modular system according to claim 1, wherein a plurality of panel retaining elements is mounted onto the building and wherein adjoining panels are in the recesses of the retaining elements and wherein the upstanding panel flange of a first panel and the upstanding panel flange of a second panel longitudinally adjoin to allow mounting the adjoining panels with the adjoining panel flanges of the panels in the recesses in the upstanding flanges of one or more retaining elements.

16. Method of assembling a modular system of claim 1 into a facade structure on a building using a plurality of panels members and panel retaining elements for mounting the panels to the building wherein said panels comprise an intermediate portion extending between two upstanding panel flanges located on opposite edges of the intermediate portion and wherein the free ends of the upstanding panel flanges are bent to extend towards the back side of the intermediate portion of the panel thereby forming substantially v- or u-shaped flanges and wherein the free ends of the bent upstanding panel flanges do not touch the back side of the intermediate portion, and wherein said panel retaining elements comprise a base portion for securing the retaining element to the building and at least one upstanding retaining element flange, wherein the upstanding retaining element flange is provided with recesses, and which recesses are provided with securing notches, the method comprising the step of mounting subsequent panels to the building structure by snapping the free ends of the v- or u-shaped flanges of the panels into the corresponding recesses in the upstanding retaining element flanges of one or more retaining elements, and wherein the securing notches secure the panels in place, without the use of a male-female connection between subsequent panels, wherein the angle between one of the upstanding panel flanges and the intermediate portion of the panels is smaller than 90° and the angle between the other upstanding panel flange and the intermediate portion of the panel is larger than 90° and wherein the panels are made from sheet material by roll-forming.

17. Method of assembling a facade structure on a building according to claim 16, wherein the consecutive panels are mounted such that the gap between the two neighbouring panels is minimized by abutting the edge of the intermediate portion of the first panel against the edge of the intermediate portion of the neighbouring panel, or wherein the consecutive panels are mounted such that the visible gap between the edges of the two neighbouring panels at the location where the panels adjoin is equidistant.

18. Method of repairing the facade structure produced in accordance with claim 16, by removing the damaged panel, by cutting the member to enable removal of the panel, without damaging the panel retaining elements holding the damaged panel, followed by replacing the removed panel by snapping a replacement panel in place.

19. Method of repairing the facade structure produced in accordance with claim 17, by removing the damaged panel, by cutting the member to enable removal of the panel, without damaging the panel retaining elements holding the damaged panel, followed by replacing the removed panel by snapping a replacement panel in place.

* * * * *